US011420792B2

(12) United States Patent
Sunohara

(10) Patent No.: US 11,420,792 B2
(45) Date of Patent: Aug. 23, 2022

(54) HANDLE, AND CONTAINER WITH HANDLE

(71) Applicant: NISSEI ASB MACHINE CO., LTD., Nagano (JP)

(72) Inventor: Makoto Sunohara, Nagano (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 205 days.

(21) Appl. No.: 16/498,092

(22) PCT Filed: Mar. 27, 2018

(86) PCT No.: PCT/JP2018/012575
§ 371 (c)(1),
(2) Date: Sep. 26, 2019

(87) PCT Pub. No.: WO2018/181394
PCT Pub. Date: Oct. 4, 2018

(65) Prior Publication Data

US 2020/0270023 A1 Aug. 27, 2020

(30) Foreign Application Priority Data

Mar. 31, 2017 (JP) ..... JP2017-069779

(51) Int. Cl.
*B65D 23/10* (2006.01)
*B65D 21/02* (2006.01)

(52) U.S. Cl.
CPC ..... *B65D 23/104* (2013.01); *B65D 21/0231* (2013.01)

(58) Field of Classification Search
CPC .. B65D 1/023; B65D 1/0284; B65D 21/0231; B65D 23/104; B65D 2303/00; A45F 5/102; A45F 5/10; A45F 2005/1066
(Continued)

(56) References Cited

U.S. PATENT DOCUMENTS 6,394,517 B1 * 5/2002 Borg ..... A45F 5/10 215/397
6,880,714 B2 * 4/2005 Blanchester ..... B65D 23/003 215/395
(Continued)

FOREIGN PATENT DOCUMENTS

CN 202226143 U 5/2012
EP 1 520 793 A1 4/2005
(Continued)

OTHER PUBLICATIONS

Official Communication issued in International Application No. PCT/JP2018/012575, dated May 15, 2018.
(Continued)

*Primary Examiner* — Don M Anderson
*Assistant Examiner* — Madison L Poos
(74) *Attorney, Agent, or Firm* — Greenblum & Bernstein, P.L.C.

(57) ABSTRACT

Provided is a handle including an annular part configured to fit in a neck part of a container, a first extension part provided so as to be continuous with the annular part, and a first holding part provided so as to be continuous with the first extension part, in which the annular part includes a second contact part capable of coming into contact with a first contact part provided to the neck part, and the first extension part is configured to be positioned with respect to the container by the contact between the first contact part and the second contact part.

7 Claims, 9 Drawing Sheets

(58) Field of Classification Search
USPC ..... 206/499, 503, 508, 509, 510; 215/10, 215/396; 220/752, 754, 755, 758
See application file for complete search history.

(56) References Cited

U.S. PATENT DOCUMENTS

| | | | | |
|---|---|---|---|---|
| D635,460 | S | 4/2011 | Dorn et al. | |
| D662,421 | S | 6/2012 | Dorn | |
| D667,299 | S | 9/2012 | Dorn | |
| D669,357 | S | 10/2012 | Dorn | |
| 2005/0035084 | A1* | 2/2005 | Simpson | B65D 1/023 215/396 |
| 2007/0114200 | A1* | 5/2007 | Lane | B65D 21/0231 215/10 |
| 2010/0032457 | A1* | 2/2010 | Field | A45F 5/00 224/148.1 |
| 2011/0132790 | A1* | 6/2011 | Dorn | B65D 21/0231 206/509 |
| 2011/0132863 | A1 | 6/2011 | Dorn | |
| 2013/0008915 | A1* | 1/2013 | Dorn | A45F 5/102 220/755 |
| 2014/0110369 | A1 | 4/2014 | Laib et al. | |

FOREIGN PATENT DOCUMENTS

| | | | |
|---|---|---|---|
| EP | 1 795 453 | A1 | 6/2007 |
| EP | 1 803 654 | A1 | 7/2007 |
| EP | 2292519 | | 9/2011 |
| JP | 3072867 | | 8/2000 |
| JP | U3083919 | | 2/2002 |
| JP | 2003-002362 | | 1/2003 |
| JP | 2001-030341 | | 2/2011 |
| JP | 2011-020729 | | 2/2011 |
| JP | 2013-538162 | | 10/2012 |
| JP | 2014-518186 | | 7/2014 |

OTHER PUBLICATIONS

Office Action issued in International Application No. PCT/JP2018/012575, dated May 15, 2018.
Extended European Search Report issued in the corresponding European patent application 18774609.4. dated Jan. 20, 2021.
Office Action dated Jun. 12, 2020 in Chinese Patent Application No. 201880022731.2 and English translation thereof.

* cited by examiner

HANDLE, AND CONTAINER WITH HANDLE

TECHNICAL FIELD

The present invention relates to a handle that is independently attachable to a container and a container including the handle.

BACKGROUND ART

In a container of a relatively large size that contains mineral water, edible oil, or the like, there is a case where a hanging type handle (suspending tool) is provided at a neck part of the container for improving convenience during transportation and handling. The handle has a preform integral type (Patent Literatures 1 and 2) and an attached (separate body) type (Patent Literature 3). In addition, as a container including a handle, there is a stackable container (Patent Literature 4) in which a reduction of storage space is taken into account. In the stackable container, a bottom concave-convex area of an upper container engages a shoulder concave-convex area of a lower container to enhance stability during stacking.

CITATION LIST

Patent Literature

Patent Literature 1: Japanese Utility Model Registration number 3072867

Patent Literature 2: JP-A-2001-030341

Patent Literature 3: JP-T-2014-518186

Patent Literature 4: JP-T-2013-538162

SUMMARY OF INVENTION

Technical Problem

In an integrated handle-attached container, a molding process may be complicated. In addition, in the case of an integral handle, shape and material options may be limited, and thus, there is a case where it is difficult to form a large handle or a case where the strength is weakened. Further, as disclosed in Patent Literature 2, in a container with an integral handle, the handle is often formed integrally with a neck part of a container. Here, when the size of the container is about 5 gallons (about 20 liters), a load of about 20 kg locally acts on the handle forming position. It is very difficult to suitably form an integral handle that can withstand the load. There is also a limitation that the material of the handle (the type of synthetic resin) must be the same as that of the container.

The attached handle can be molded independently of the container, and a degree of freedom of molding is high. On the other hand, in the attached handle in the related arts, the handle freely rotates with respect to the neck part even after the handle is attached to the neck part of the container. When a holding part of the handle is placed in the bottom concave-convex area of the upper container and the shoulder concave-convex area of the lower container when the container is stacked, the stack of the containers becomes unstable. Therefore, in the case of stacking, an operation of adjusting the direction of the handle is required so that the handle is not sandwiched between the upper container and the lower container, and thus, there is a problem in terms of handling.

An object of the invention is to provide a handle in which a shape, a material, and a size can be widely selected and an operation of housing a container can be simplified.

In addition, another object of the invention is to provide a container that includes an attached handle which can simplify the accommodation operation.

Solution to Problem

The handle according to the invention capable of solving the above problems includes an annular part configured to fit in a neck part of a container;

a first extension part provided so as to be continuous with the annular part, and a first holding part provided so as to be continuous with the first extension part, wherein the annular part includes a second contact part capable of coming into contact with a first contact part provided to the neck part in a circumferential direction of the neck part, and wherein the first extension part is configured to be positioned with respect to the container by the contact between the first contact part and the second contact part.

According to the handle of the configuration, the handle can be positioned by moving (rotating) the handle after the handle is attached to the neck part so as to bring the contact part of the neck part into contact with the contact part of the annular part. In addition, unlike the integral handle, the handle can be molded in a separate step from the container, and thus, the shape, material, and size of the handle can be selected in a wide range. It is also easy to design so as to increase a degree of rigidity required for a large container. For example, by positioning the handle, it is possible to eliminate the work of a device and a person for alignment of the handle and to simplify an operation of housing the container before transportation.

In the handle of the invention, it is preferable that:

the annular part includes a detachment prevention part that is configured to prevent the handle from coming off from the container; and a part of the detachment prevention part is the second contact part.

According to the handle of this configuration, it is possible to prevent the handle from coming off from the container, and to further perform positioning by a part of the detachment prevention part, thereby realizing detachment prevention and positioning by an integral mechanism.

In the handle of the invention, it is preferable that the handle further includes:

a second extension part provided so as to be continuous with the annular part in a direction opposite to the first extension part, and a second holding part provided so as to be continuous with the second extension part.

According to the handle of the configuration, since the container can be carried by holding the two holding parts extending in two directions, even when the container is large and heavy, the container can be stably transported. In addition, even in a case of being boxed, since the holding parts extend in two directions, the holding part can be easily taken out from either of the directions in which the holding parts are provided.

A container including a handle of the invention includes:

a neck part to which a cap is capable of being attached;

a shoulder part that extends below the neck part;

a body part that extends below the shoulder part; and a bottom part that closes a lower end of the body part, wherein the neck part includes a first contact part that is capable of coming into contact with the second contact part of the above-described handle according to the invention, and wherein the handle is positioned by the contact between the first contact part and the second contact part.

According to the container of the configuration, the handle is moved (rotated) after the handle is attached to the container, and the contact parts are brought into contact with each other, whereby the handle is fixed to a predetermined position of the neck part. Accordingly, work of a device and a person for alignment of the handle becomes unnecessary and it is possible to simplify an operation of housing the container before transportation.

In the container according to the invention, it is preferable that:

the container is stackable in a self-standing manner by causing a part of the bottom part to come into contact with a part of the shoulder part of another container, and the bottom part includes a relief part capable of accommodating the handle when the container is stacked.

According to the container of the configuration, since the handle can be reliably accommodated in the relief part of the container bottom part, it is possible to prevent the holding part of the handle from being placed in the bottom concave-convex region of the upper container and the shoulder concave-convex region of the lower container to become unstable. Accordingly, the stack of containers is stabilized and work of a device and a person for alignment of the handle becomes unnecessary.

Advantageous Effects of Invention

According to the invention, it is possible to provide a handle in which a shape, a material, and a size can be widely selected and an operation of housing a container can be simplified.

In addition, according to the invention it is possible to provide a container that includes an attached handle which can simplify the accommodation operation.

DESCRIPTION OF EMBODIMENTS

Hereinafter, an embodiment of a handle and a container including the handle according to the invention will be described with reference to the drawings.

Figure 1:
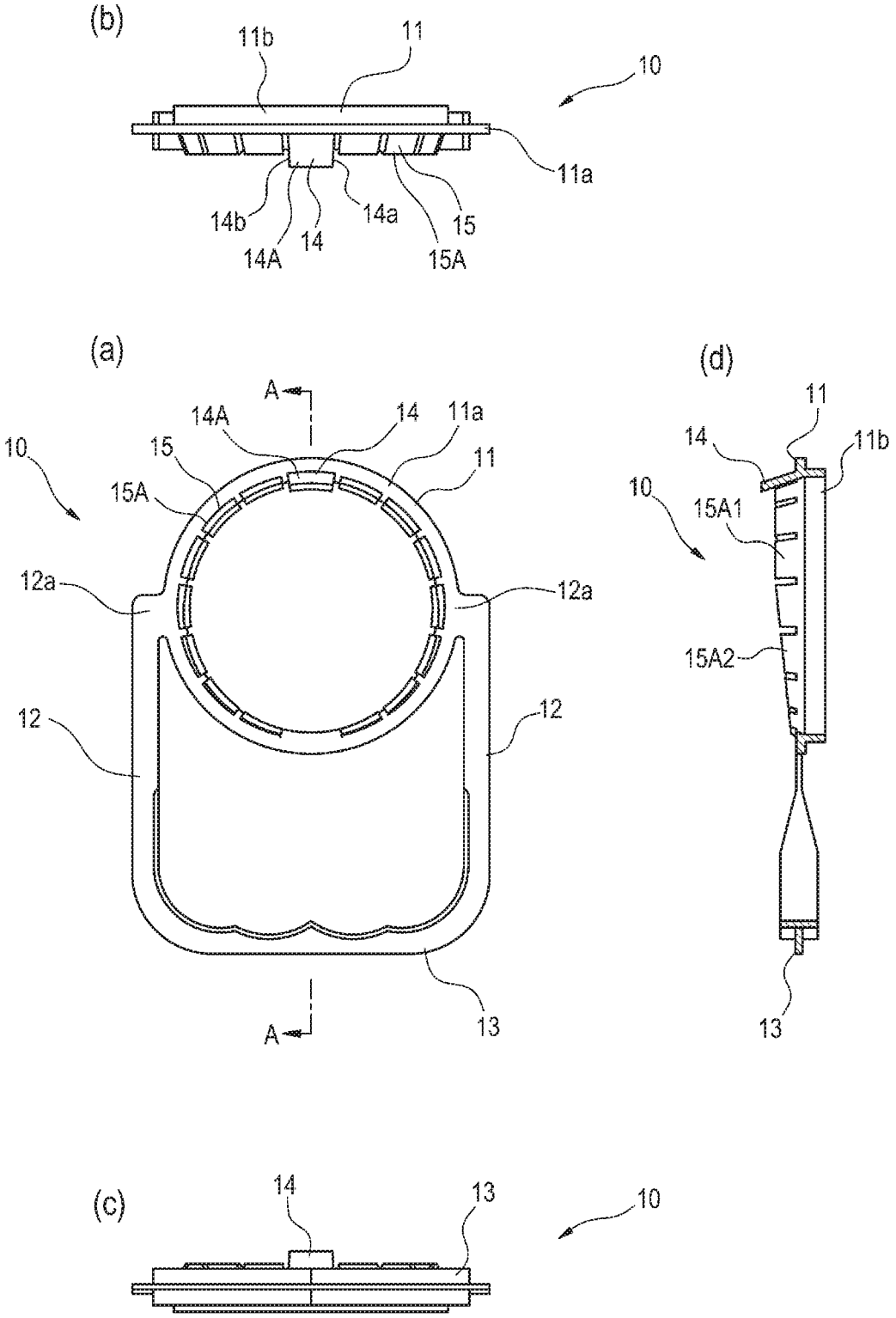
FIG. 1 is a view illustrating a handle according to an embodiment, in which (a) is a front view of the handle, (b) is a plan view of the handle, (c) is a bottom view of the handle, and (d) is a cross-sectional view taken along a line A-A of the handle.

As shown in FIG. 1, the handle 10 according to the embodiment includes an annular part 11 configured to be fitted to a neck part 21 (see FIG. 2) of a container 20 to be described later, two first extension parts 12 provided to be continuous with the annular part 11, and a first holding part 13 provided so as to be continuous with the two first extension parts 12. The handle 10 is made of synthetic resin, for example, made of polypropylene, polyethylene (made of polyolefin), or polyethylene terephthalate (polyester), and is manufactured by an injection molding method. The synthetic resin is selected from a synthetic resin excellent in, for example, moldability, drop strength, and cost, and may be different from the synthetic resin of the container 20.

The annular part 11 includes at least one second contact part 14 that is capable of coming into contact with at least one first contact part 26 (see FIGS. 2 and 3) that is provided to a neck part 21 of the container 20 which will be described later in a circumferential direction of the neck part 21. In the embodiment, the second contact part 14 is formed to the annular part 1 so as to fit in the first contact part 26 formed by cutting out a part of a flange (support ring) 25 that is formed in the circumferential direction of the neck part 21 of the container 20. The annular part 11 is formed in a hollow, substantially cylindrical shape that is short in a vertical direction (The vertical state refers to a vertical (upward and downward) direction in a state where the handle 10 is attached to the container 20 and a bottom part 24 (see FIG. 2) of the container 20 is placed downward. In the following description, in a case of referring to the upward and downward direction of the handle 10, in the state where the handle 10 is attached to the container 20, a direction from the neck part 21 toward the bottom part 24 of the container 20 is referred to as the downward direction, and a direction from the bottom part 24 toward the neck part 21 of the container 20 is referred to as the upward direction. However, in a case of describing with reference to the drawings, it may also be described with reference to directions of the drawings), and includes an outer edge part 11*a* to which the first extension part 12 and a detachment prevention part 15 which will be described below are continuously provided, and a cylindrical part 11*b* extending in the downward direction therefrom (upward direction in (b) of FIG. 1). In order to more reliably lock the handle 10 to the neck part 21, the number of the second contact part 14 may also be increased. For example, two second contact parts 14 may be provided at regular intervals of every 180°, three second contact parts 14 may be provided at regular intervals of every 120°, or four second contact parts 14 may be provided at regular intervals of every 90° with reference to a center of the annular part 11 in a circumferential direction of the annular part 11 (however, it is also necessary to change the number of the first contact part 26 as appropriate).

The outer edge part 11*a* has a larger diameter than the cylindrical part 11*b*, has an annular-shaped appearance in which a plate is provided along an outer periphery of the cylindrical part 11*b* ((a) of FIG. 1), and protrudes in the outer diameter direction of the cylindrical part 11*b* so as to form a flange from the upper end of the cylindrical part 11*b*. The second contact part 14 includes a first upright part 14A protruding upward (downward in (b) of FIG. 1) from an upper end of the outer edge part 11*a*. The first upright part 14A has a substantially arc shape in a front view ((a) of FIG. 1), and is configured as a thin plate member having a substantially trapezoidal shape that gradually increases in diameter as facing a downward direction in a plan view ((b) of FIG. 1). The second contact part 14 is formed such that the circumferential length of the annular part 11 is slightly shorter than the circumferential length of the first contact part 26 in the circumferential direction.

In addition, the annular part 11 includes the detachment prevention part 15 that prevents the handle 10 from coming off from the container 20. The detachment prevention part 15 includes a plurality of second upright parts 15A, and is provided so as to be inclined in the inner diameter direction of the outer edge part 11*a* from the upper end of the outer edge part 11*a*. A shape of the second upright part 15A is substantially the same as that of the first upright part 14A. However, the first upright part 14A is formed higher and thicker than the second upright part 15A. Hereinafter, the first upright part 14A and the second upright part 15A may be collectively referred to as claws. In the embodiment, the detachment prevention part 15 is narrowly formed so as to become higher with respect to a plane of the annular part 11 (an upper end surface of the outer edge part 11*a*) toward the inside of the annular part 11 so as to catch the neck part 21 of the container 20 after the handle 10 is attached to the container 20. In addition, in the embodiment, the detachment prevention part 15 is formed as, for example, 15 claws that are independently arranged side by side in the circumferential direction of the annular part 11. When the handle 10 is attached to the container 20, at least a part of the plurality of claws comes into contact with the flange 25 of the container 20 in the height direction of the container 20 (see FIG. 3). Further, in the embodiment, the above-described second contact part 14 is formed as a part of the above-described detachment prevention part 15 (a plurality of claws). Second contact points 14*a* and 14*b* are provided at ends of the second contact part 14 in the circumferential direction. The detachment prevention part 15 other than the second contact part 14 in the embodiment is formed such that the size thereof in the height direction of the container 20 is smaller than that of the second contact part 14.

All of the detachment prevention parts 15 (second upright part 15A) may have the same heights. However, the heights may also be changed by configuring the detachment prevention parts 15 from a relatively high (long) second upright part 15A1 and a relatively low (short) second upright part 15A2 ((d) of FIG. 1). In this case, a rigidity of the second upright part 15A2 is higher than that of the second upright part 15A1. It is preferable that the relatively high second upright part 15A1 is provided on a side where the second contact part 14 (first upright part 14A) of the annular part 11 is located, and the relatively low second upright part 15A2 is provided on a side where the first holding part 13 of the annular part 11 is located, with connection parts 12*a* described later as a boundary. In addition, it is preferable that the height of the second upright part 15A2 is set so as to gradually decrease toward a side closer to the first holding part 13 of the annular part 11.

Two first extension parts 12 are formed so as to extend from positions apart from each other by 180° in the circumferential direction of the annular part 11, and are substantially parallel to each other. The connection parts 12*a* are formed between the first extension parts 12 and the annular part 11 ((a) of FIG. 1).

The first holding part 13 is formed to be continuous with the two first extension parts 12, and forms a space into which a users' hand is inserted with the annular part 11 and the two first extension parts 12. The first holding part 13 is formed as a grip in a waveform shape so as to conform to the shape of fingers of the user. Further, a width of a part of the inner peripheral sides of the first holding part 13 and the two first extension parts 12 that comes into contact with the user's fingers is formed to be wide in the upward and downward direction.

Figure 2:
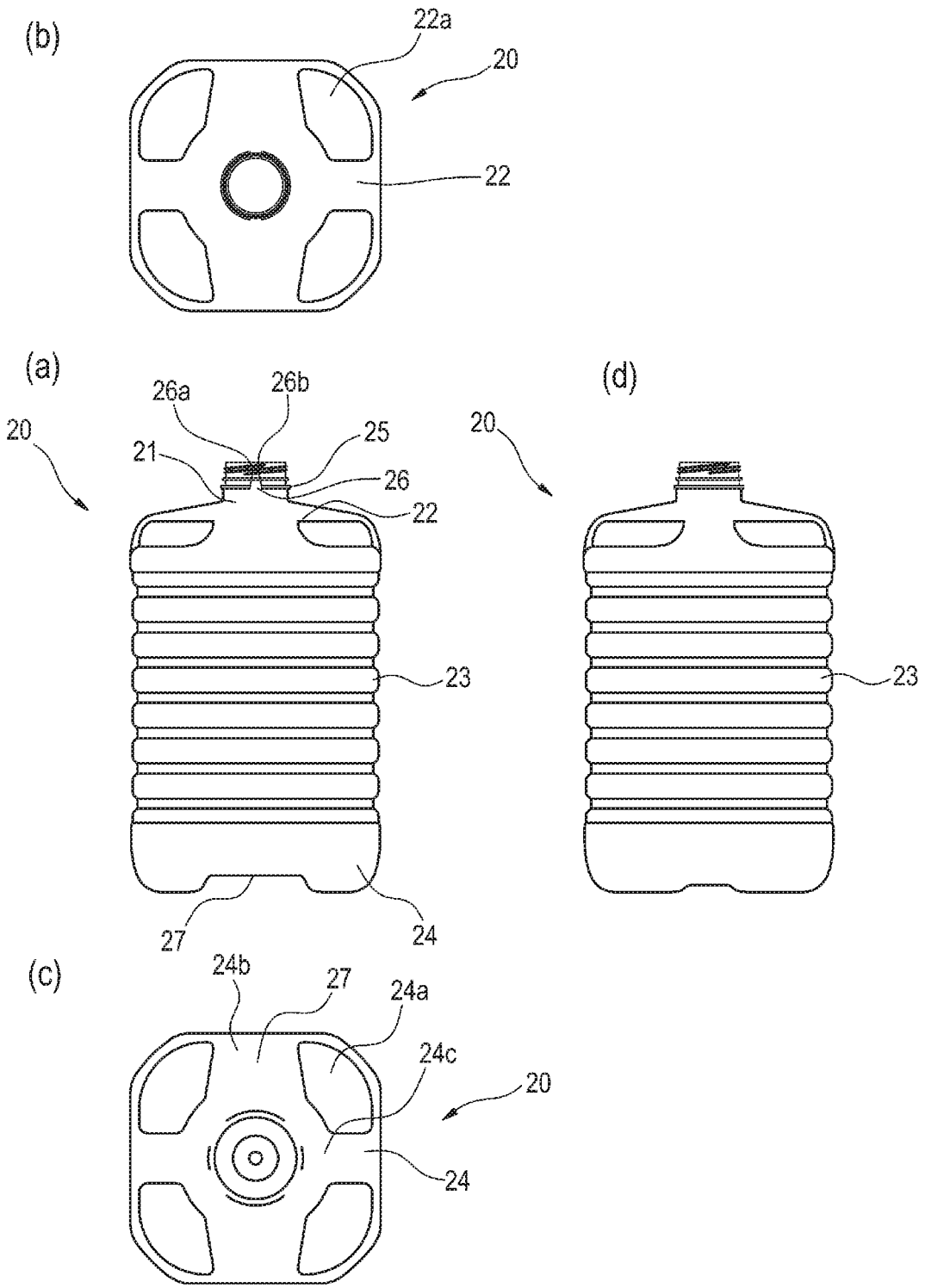
FIG. 2 is a view illustrating a container to which the handle according to the embodiment is capable of being attached and which is capable of positioning the handle, in which (a) is a front view of the container, (b) is a plan view of the container, (c) is a bottom view of the container, and (d) is a side view of the container.

The container 20 according to the embodiment is a container to which the handle 10 according to the embodiment is capable of being attached and which is capable of positioning the handle 10. As shown in FIG. 2, the container 20 has a neck part 21 to which a cap can be attached, a shoulder part 22 that extends below the neck part 21, a body part 23 that extends below the shoulder part 22, and a bottom part 24 that closes the lower end of the body part 23. The container 20 is made of synthetic resin, for example, made of polyethylene terephthalate (made of polyester) or made of polycarbonate, and is manufactured by a blow molding method.

Figure 3:
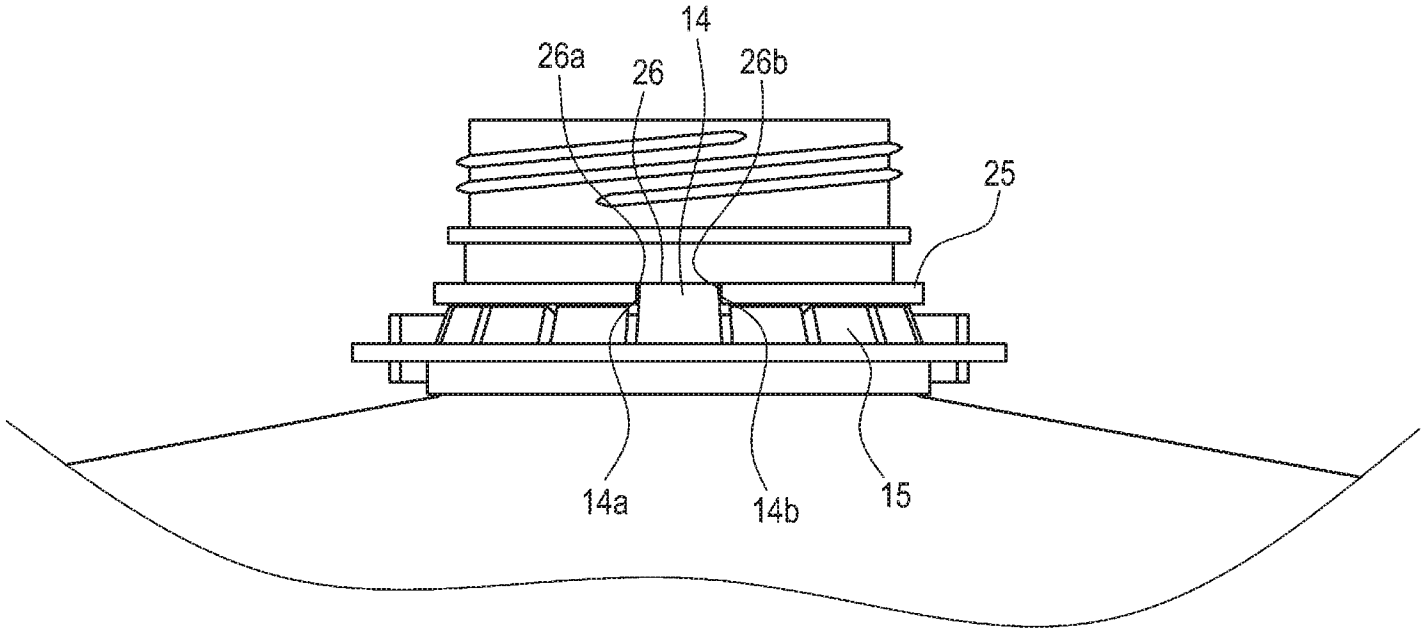
FIG. 3 is a view illustrating a state of positioning the handle of the container according to the embodiment.

The neck part 21 includes at least one first contact part 26 that is capable of coming into contact with the second contact part 14 of the handle 10. In the embodiment, the first contact part 26 is formed by partially cutting out a part of the flange 25 formed in the circumferential direction of the neck part 21. In other words, the first contact part 26 is configured as a recessed groove (notch) formed along an outer peripheral edge of the flange 25. First contact points 26*a* and 26*b* are provided at the ends of the first contact part 26 in the circumferential direction. As shown in FIG. 3, in the container 20 including the handle 10, the first contact part 26 and the second contact part 14 are in contact in the circumferential direction to position the handle 10. The positioning is performed by the contact between the first contact point 26*a* and the second contact point 14*a* and/or the contact between the first contact point 26*b* and the second contact point 14*b*. It is preferable that two first contact parts 26 are provided at positions 180° apart from each other in the circumferential direction of the flange 25. Further, three or more first contact parts 26 may also be provided in the circumferential direction of the flange 25 in order to increase variation of a positioning direction of the handle 10. For example, three first contact parts 26 may be provided at regular intervals of every 120°, or four first contact parts 26 may be provided at regular intervals of every 90° with reference to a center of the flange 25 in a circumferential direction of the flange 25.

Figure 4:
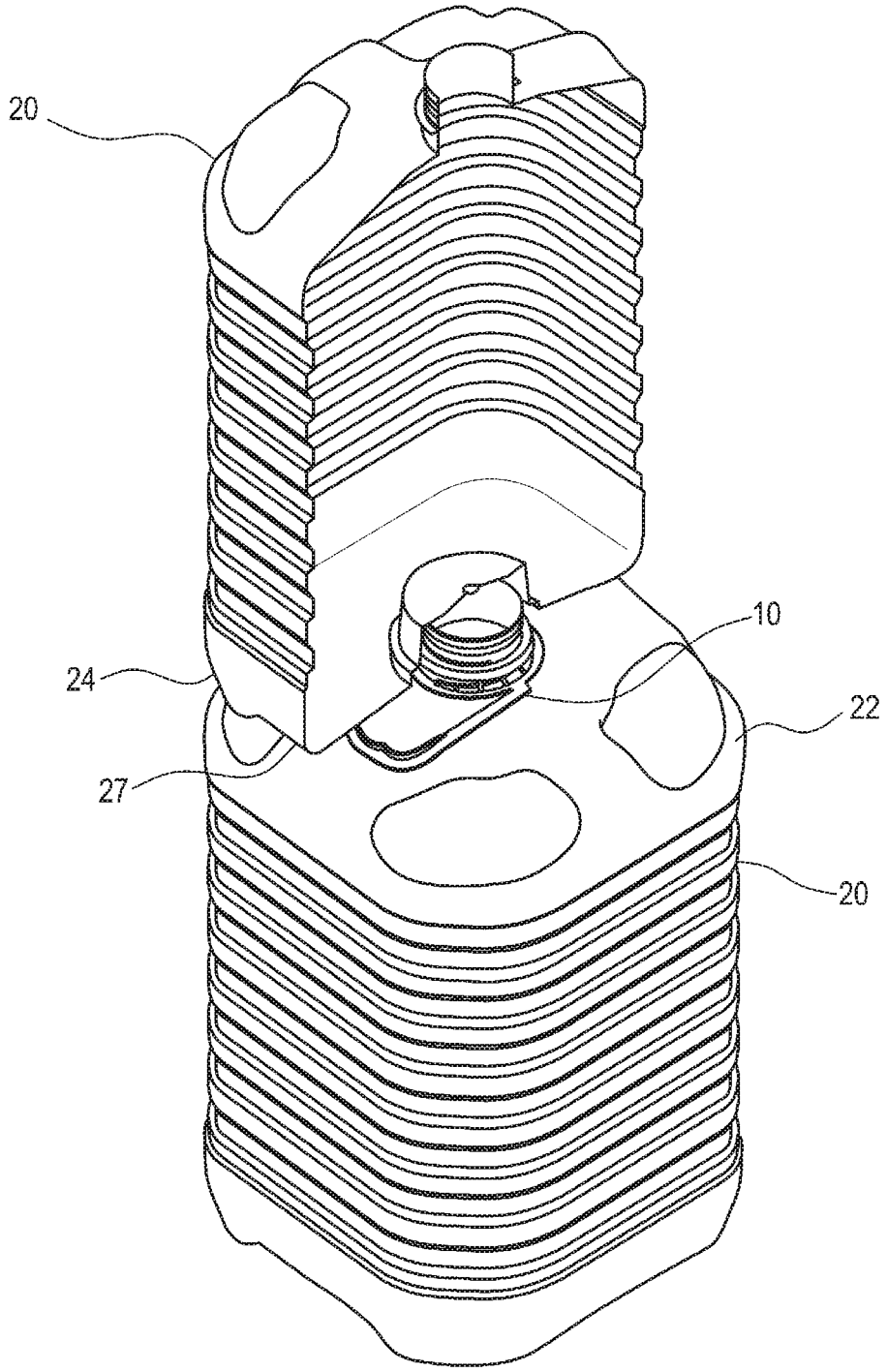
FIG. 4 is a perspective view illustrating a state in which the container according to the embodiment is stacked, and is a partial cross-sectional view of the container stacked on another container.
Figure 5:
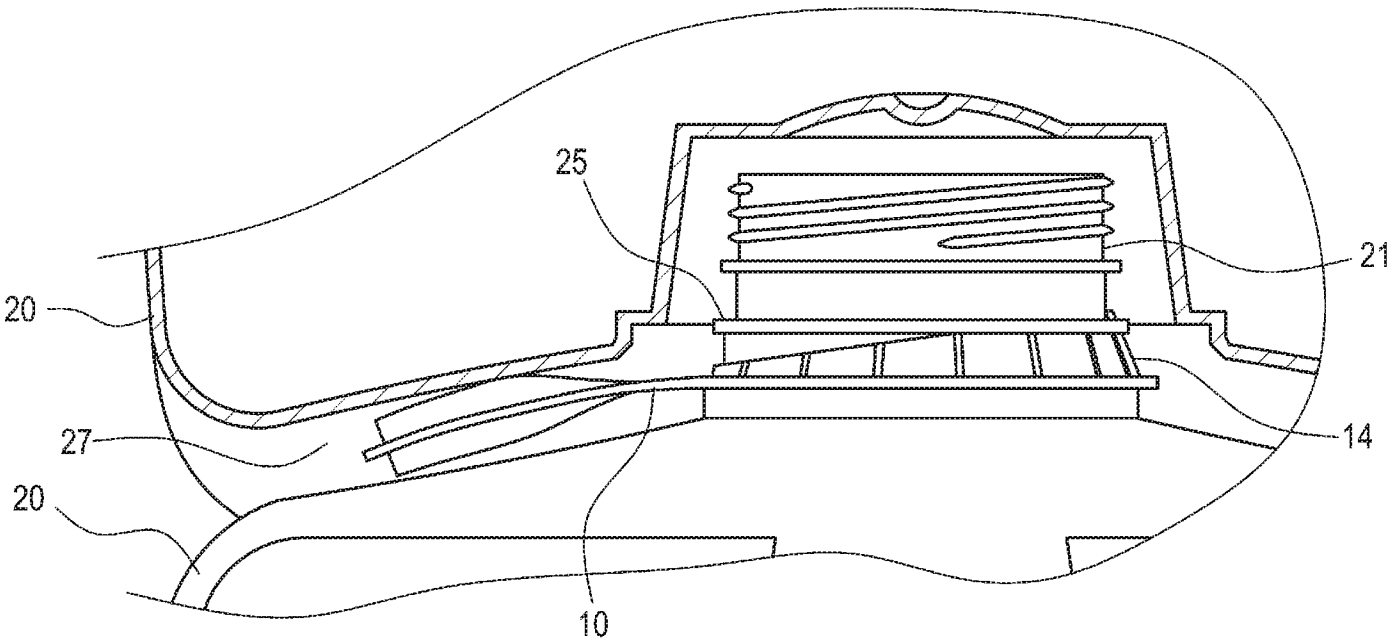
FIG. 5 is a view illustrating a state in which the container according to the embodiment is stacked.
Figure 6:
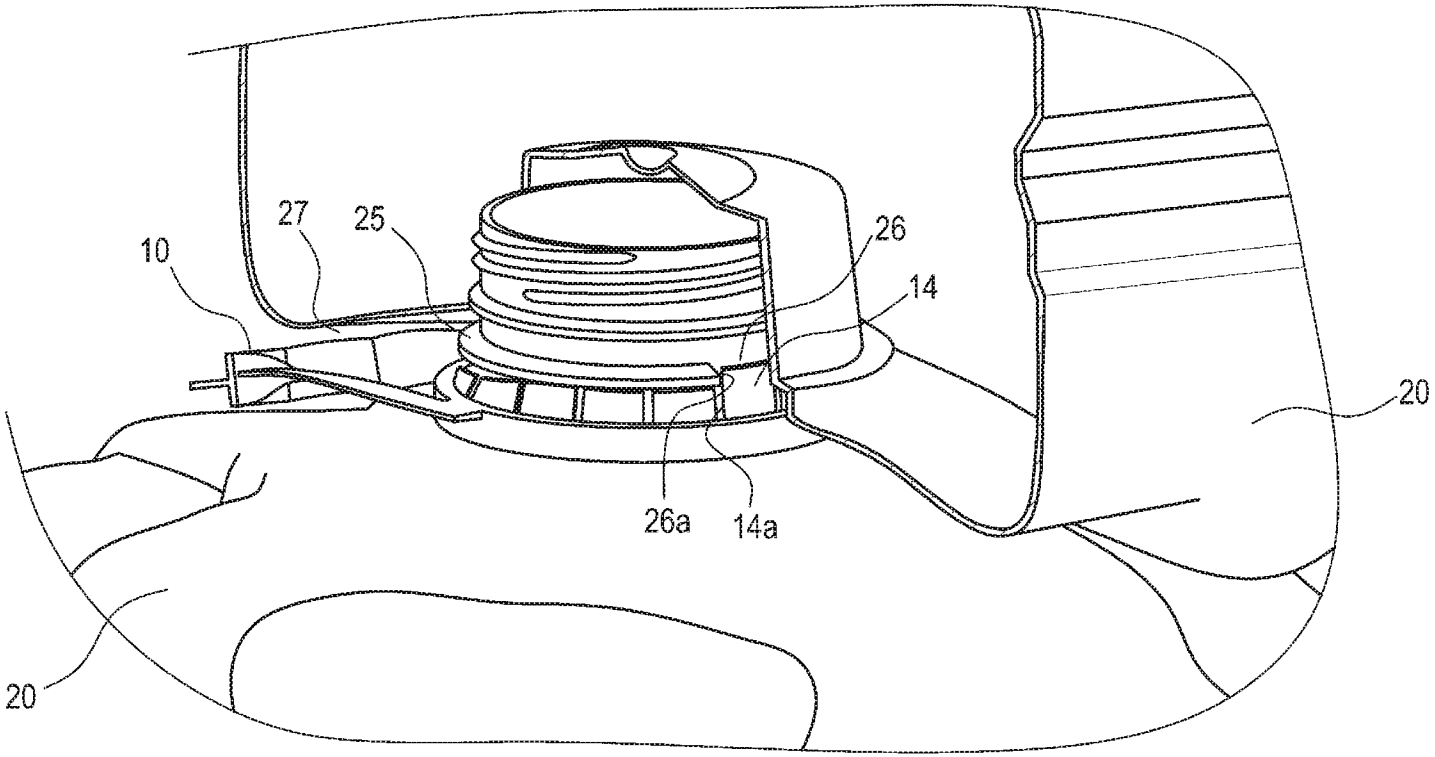
FIG. 6 is a view illustrating the state in which the container according to the embodiment is stacked.

The container 20 can be stacked in a self-standing manner with a part of the bottom part 24 to come into contact with a part of the shoulder part 22 of another container 20, as shown in FIG. 4, and the bottom part 24 includes a relief part 27 capable of accommodating the handle 10 when the container 20 is stacked. The bottom part 24 is provided with four convex leg parts 24*a* each having a substantially fan-shaped horizontal cross section at a position radially outward in a constant distance from the central part, and the shoulder part 22 is provided with four concave flat parts 22*a* each having a substantially fan-shaped horizontal cross section at a position radially outward in a constant distance from the neck part 21, respectively. A recessed part formed between the two convex leg parts 24*a* is the relief part 27. In order to make the stack of containers more stable, it is preferable to increase the area of the convex leg parts 24*a* and the concave flat parts 22*a*. In the embodiment, only the recessed part 24*b* corresponding to the relief part 27 accommodating the handle 10 is formed to be wide, and the recessed part 24*c* orthogonal thereto is formed to have a narrow width. It is preferable that two relief parts 27 are formed in the bottom part 24, and are formed at positions symmetrical with respect to the center of the bottom part 24. As shown in FIG. 5 and FIG. 6, when the container 20 including the handle 10 is stacked, the handle 10 is accommodated in the relief part 27 provided with a wide width in the bottom part 24 of the container 20.

According to the embodiment, the handle 10 can be positioned by moving (rotating) the handle 10 after the handle 10 is attached to the neck part 21 so as to bring the first contact part 26 of the neck part 21 into contact with the second contact part 14 of the annular part 11. In addition, unlike the integral handle, a separate handle 10 can be molded in a separate step from the container 20, and thus, the shape, material, and size of the handle 10 can be selected in a wide range. The handle 10 with sufficient rigidity can be designed even if the size of the container 20 on which the handle 10 is attached is 5 gallons (about 20 liters). For example, by positioning the handle 10 in a direction that does not interfere with the boxing of the container 20 including the handle 10, it is possible to eliminate the work of a device and a person for alignment of the handle 10 and to simplify an operation of housing the container before transportation.

Further, according to the embodiment, since the annular part 11 includes the detachment prevention part 15, it is possible to prevent the handle 10 from unintentionally coming off from the container 20. Although it is possible to open a plurality of claws that are the detachment prevention unit 15 and move the annular part 11 from the top of the flange 25 to the bottom of the flange 25 at the time of attaching, when the handle 10 is to be detached from the container 20, it is possible to prevent unexpected detachment of the handle 10 because the claw is caught by the flange 25 of the container 20 as shown in FIG. 3. Further, detachment prevention and positioning can be realized by an integral mechanism since the second contact part 14 is formed as a part of the detachment prevention part 15.

When the height of the claws (the first upright part 14A and the second upright part 15A) is decreased toward the first holding part 13 (when a low (short) second upright part 15A2 is provided on the side of the first holding part 13), in a stationary state, a gap is formed between the flange 25 and the annular part 11 (the upper end of the second upright part 15A2) on the side where the first holding part 13 is provided, so that the handle 10 can be moved upward with respect to the flange 25. Thereby, easiness of lifting is improved. Further, at the time of lifting, the container 20 is supported in a state in which the neck part 21 is slightly inclined to the opposite side of the handle 10 due to the relationship between a center of gravity and a fulcrum (the position of the connection part 12*a*). At this time, the handle 10 is bent, and a support surface is formed by a contact between the lower surface of the flange 25 and the second upright part 15A having a high degree of rigidity. Therefore, stability at the time of holding is enhanced.

In addition, according to the embodiment, since the stackable container 20 includes the relief part 27, the handle 10 can be reliably accommodated in the relief part 27. Since the handle 10 is not sandwiched by the contact parts between the containers 20 when the containers 20 are stacked, the container can be prevented from collapsing due to unstableness of stacking of the containers when the handle is sandwiched between the stacked containers. Further, for an attached handle that rotates after the attachment in related arts, it is necessary to move the handle by a person or a device so that the handle is not sandwiched between containers, while for the handle 10 and the container 20 that includes the handle 10 of the embodiment, since the handle 10 is positioned with respect to the container 20 when the handle 10 is attached, the work of the device or the person for alignment of the handle 10 becomes unnecessary.

As described above, according to the above-described embodiment, it is possible to provide the handle 10 which can simplify the operation of housing the container 20 and the container including an attached handle whose operation of housing can be simplified.

Figure 7:
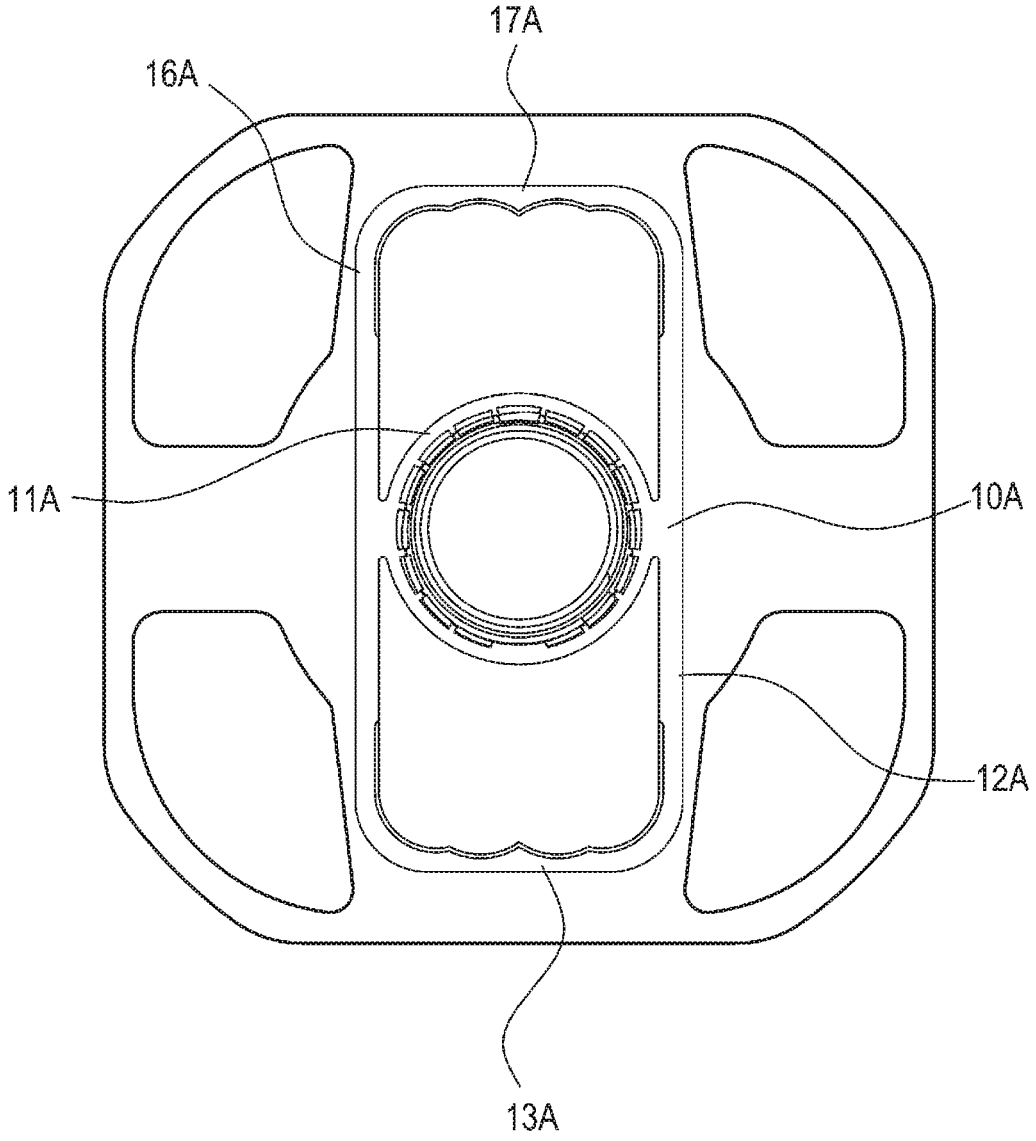
FIG. 7 is a view illustrating a first modification of the embodiment.

As a first modification of the embodiment, as shown in FIG. 7, a handle 10A can be exemplified, which includes a second extension part 16A provided so as to be continuous with the annular part 11A in a direction opposite to the first extension part 12A and a second holding part 17A provided so as to be continuous with the second extension part 16A.

The second extension part 16A and the second holding part 17A may be provided in a similar shape as the two first extension parts 12A and the first holding parts 13A of the handle 10A of the modification, or may also be provided as different shapes.

In the first modification, since the container can be carried by holding the two holding parts extending in two directions, even when the container is large and heavy, the container can be stably transported. In addition, even in a case of being boxed, since the holding parts extend in two directions, the holding part can be easily taken out from either of the directions in which the holding parts are provided.

Figure 8:
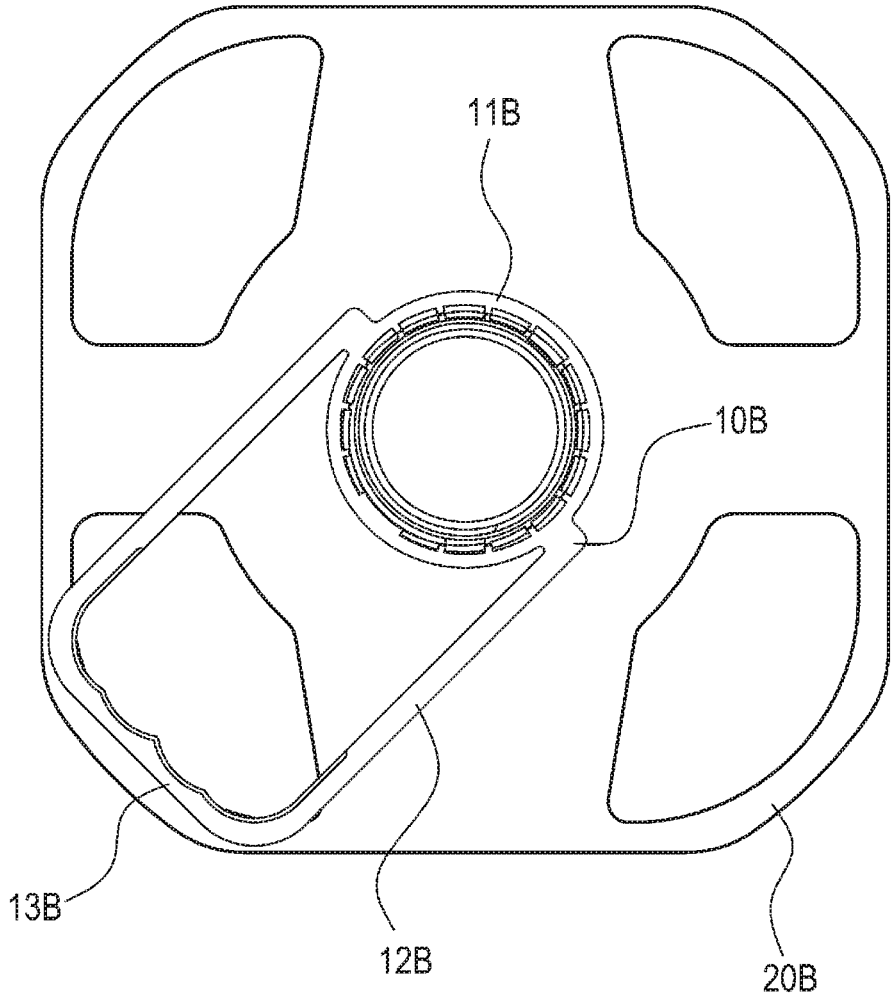
FIG. 8 is a view illustrating a second modification of the embodiment.

As a second modification of the embodiment, as shown in FIG. 8, the contact part of the shoulder part 22B and the bottom part 24B of the container 20B may be located in a space formed by the annular part 11B of the handle 10B, the first extension part 12B, and the first holding part 13B, so that the handle 10B is positioned in a top surface view corner direction of the container 20B. In the case, by positioning the handle 10B obliquely with respect to the container 20B, the handle 10B can be formed in a larger size.

Figure 9:
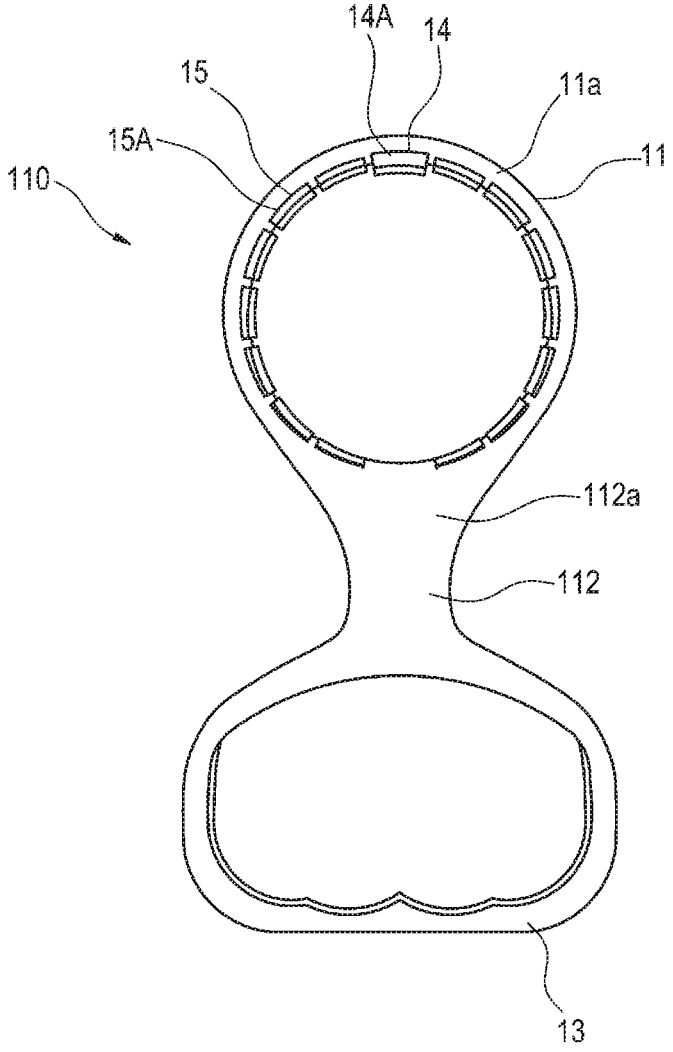
FIG. 9 is a view illustrating a third modification of the embodiment.

As a third modification of the embodiment, as shown in FIG. 9, a handle 110 can be exemplified, which includes an annular part 11, one first extension part 112 provided so as to be connected with the annular part 11 via a connection part 112*a*, and a first holding part 13 provided so as to be connected with the one first extension part 112. The annular part 11 includes a second contact part 14 (first upright part 14A), a detachment prevention part 15 (second upright part 15A), an outer edge part 11*a*, and a cylindrical part 11*b* (not shown). Since the configuration of the handle 110 other than the connection part 112*a* and one first extension part 112 is the same as that described in the above embodiment, descriptions with the same reference numerals are omitted.

In the handle 110, the connection part 112*a* is provided at the lower end of the annular part 11 in FIG. 9, and the first extension part 112 extends downward in FIG. 9 from the connection part 112*a*, and the lower end of the first extension part 112 in FIG. 9 is continuous with the central part of the first holding part 13. The first extension part 112 is formed to be wider than the first extension part 12 in the above-described embodiment, and the rigidity thereof is increased. As shown in the third modification, the handle 110 may be configured with one extension part 112.

The invention is not limited to the above-described embodiments, and modifications, improvements and the like can be made as appropriate. In addition, the material, shape, size, numerical value, form, number, arrangement position and the like of each component in the above-described embodiments are optional and are not limited as long as the invention can be achieved.

The present application is based on Japanese Patent Application No. 2017-069779 filed on Mar. 31, 2017, the contents of which are incorporated herein by reference. Also, all references cited herein are incorporated by reference in their entirety.

REFERENCE SIGNS LIST

10, 10A, 10B, 110: handle
11, 11A, 11B: annular part
11*a*: outer edge part
11*b*: cylindrical part
12, 12A, 12B, 112: first extension part
12*a*, 112*a*: connection part
13, 13A, 13B: first holding part
14: second contact part
14*a* (14*b*): second contact point
14A: first upright part
15: detachment prevention part
15A, 15A1, 15A2: second upright part
16A: second extension part
17A: second holding part
20, 20B: container
21: neck part
22, 22B: shoulder part
23: body part
24, 24B: bottom part
25: flange
26: first contact part
26*a* (26*b*): first contact point
27: relief part

The invention claimed is:

1. A handle comprising:

an annular part configured to fit in a neck part of a container;

a first extension part provided so as to be continuous with the annular part; and a first holding part provided so as to be continuous with the first extension part, wherein the annular part includes a second contact part capable of coming into contact with a first contact part provided to the neck part in a circumferential direction of the neck part, wherein the first extension part is configured to be positioned with respect to the container by the contact between the first contact part and the second contact part, wherein the annular part includes:

a flat plate; and a detachment prevention part that is configured to prevent the handle from coming off from the container, wherein the detachment prevention part includes:

the second contact part; and a plurality of upright parts, wherein the second contact part protrudes upward from an upper surface of the flat plate, and each of the plurality of upright parts protrudes upward from the upper surface of the flat plate, and wherein a size of each of the plurality of upright parts in a height direction of the container is smaller than a size of the second contact part in the height direction of the container.

2. The handle according to claim 1, further comprising:

a second extension part provided so as to be continuous with the annular part in a direction opposite to the first extension part; and a second holding part provided so as to be continuous with the second extension part.

3. A container including a handle, the container comprising:

a neck part to which a cap is capable of being attached;

a shoulder part that extends below the neck part;

a body part that extends below the shoulder part; and a bottom part that closes a lower end of the body part, wherein the neck part includes a first contact part that is capable of coming into contact with the second contact part of the handle according to claim 1, and wherein the handle is positioned by the contact between the first contact part and the second contact part.

4. The container according to claim 3, wherein the container is stackable in a self-standing manner by causing a part of the bottom part to come into contact with a part of the shoulder part of another container, and wherein the bottom part includes a relief part capable of accommodating the handle when the container is stacked.

5. The handle according to claim 1, wherein a size of each of the plurality of upright parts is a different height in the height direction of the container.

6. A container including a handle, the container comprising:

a neck part to which a cap is capable of being attached;

a shoulder part that extends below the neck part;

a body part that extends below the shoulder part; and a bottom part that closes a lower end of the body part, wherein the neck part includes a first contact part that is capable of coming into contact with the second contact part of the handle according to claim 5, and wherein the handle is positioned by the contact between the first contact part and the second contact part.

7. The handle according to claim 5, wherein the size of each of the plurality of upright parts in the height direction of the container decreases in a direction extending towards the first holding part of the annular part.

* * * * *